United States Patent [19]

Mishcon et al.

[11] 4,003,221

[45] Jan. 18, 1977

[54] ADJUSTABLE CUSHION CAM FOR A KNITTING MACHINE

[75] Inventors: Lester Mishcon; Harry Agulnek, both of Miami Beach, Fla.

[73] Assignee: The Singer Company, New York, N.Y.

[22] Filed: Nov. 12, 1975

[21] Appl. No.: 631,339

[52] U.S. Cl. ..... 66/57; 66/19

[51] Int. Cl.[2] ..... D04B 15/32

[58] Field of Search ..... 66/57, 19, 54, 78

[56] References Cited

UNITED STATES PATENTS

| | | | |
|---|---|---|---|
| 1,220,918 | 3/1917 | Wilcomb | 66/57 X |
| 2,435,269 | 2/1948 | Curtis et al. | 66/57 |
| 2,941,383 | 6/1960 | Mishcon et al. | 66/54 |
| 3,192,742 | 7/1965 | Haddad | 66/57 |
| 3,221,517 | 12/1965 | Butler | 66/57 |
| 3,386,268 | 6/1968 | Beckenstein | 66/57 X |
| 3,405,542 | 10/1968 | Beckenstein | 66/57 X |
| 3,411,326 | 11/1968 | Kent et al. | 66/54 |
| 3,572,056 | 3/1971 | Radin | 66/57 |
| 3,854,305 | 12/1974 | Bandoch et al. | 66/57 X |
| 3,882,694 | 5/1975 | Stepanek et al. | 66/57 X |

FOREIGN PATENTS OR APPLICATIONS

| | | | |
|---|---|---|---|
| 607,136 | 7/1960 | Italy | 66/57 |

*Primary Examiner*—Mervin Stein
*Assistant Examiner*—A. M. Falik
*Attorney, Agent, or Firm*—Edward L. Bell; Robert E. Smith; William V. Ebs

[57] ABSTRACT

A cushion cam is provided in association with an adjustable stitch cam and is rendered adjustable with the stitch cam such that a constant gap is maintained between the stitch and cushion cams regardless of the position selected for the stitch cam.

4 Claims, 11 Drawing Figures

Fig. 1
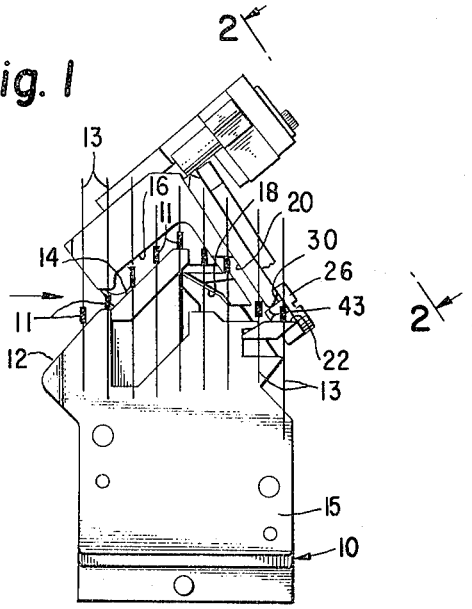
Fig. 2
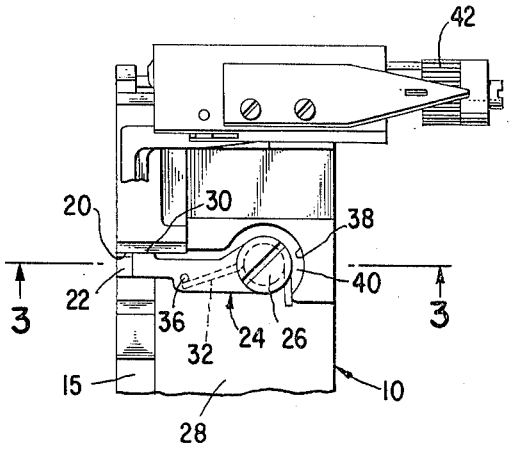
Fig. 6
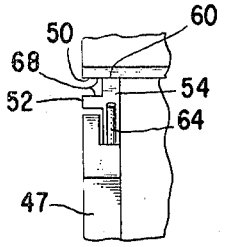
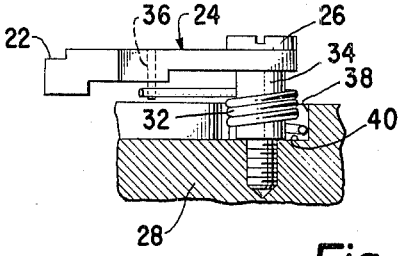
Fig. 3
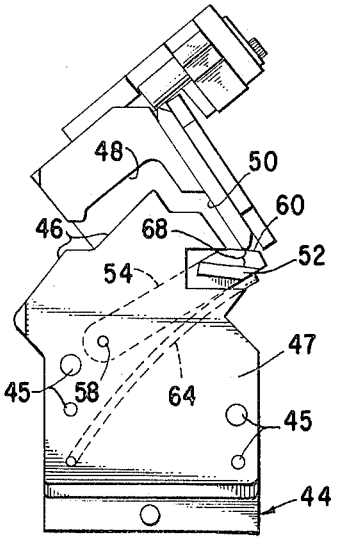
Fig. 4
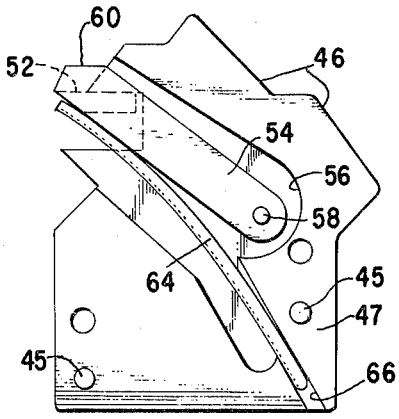
Fig. 5

ADJUSTABLE CUSHION CAM FOR A KNITTING MACHINE

BACKGROUND OF THE INVENTION

1. Field of the Invention

The invention relates to needle actuating camming for knitting machines and has particular application to the needle actuating cylinder and dial camming of circular knitting machines.

2. Background of the Invention

In order to prevent the formation of some exceptionally long stitches in fabric produced on knitting machines it is common practice to include in the needle actuating camming a cushion cam beneath each stitch cam to limit the flight of needles from the stitch cam. Stitch cams are generally made adjustable to enable an operator to select a desired stitch length whereas the cushion cams are customarily fixed. Therefore when the stitch cam is displaced relative to the cushion cam in the direction for shortening stitch length, the distance between the stitch and cushion cam is increased. As a consequence of the increased separation of the two cams, needles flying off the stitch cam may produce stitches substantially longer than desired before being stopped by the cushion cam.

SUMMARY OF THE INVENTION

In accordance with the invention a cushion cam is located on a supporting member which is spring biased against an adjustable stitch cam and mounted for movement with the stitch cam so as to maintain a constant gap between the two cams regardless of the position into which the stitch cam may be moved. The cushion cam with its supporting member is mounted in a cam section block in removable fashion such that the cushion cam may be separated from the block, machined and replaced. It is therefore unnecessary to provide a new cushion cam after it has become worn as a result of prolonged use.

DESCRIPTION OF THE DRAWINGS

FIG. 1 is a front elevational view of a cylinder cam section block and supported cams including an adjustable cushion cam according to the invention;

FIG. 2 is a partial view of the cam section block and cams of FIG. 1 taken on the plane of the line 2—2 of FIG. 1.

FIG. 3 is a fragmentary sectional view taken on the plane of the line 3—3 of FIG. 2;

FIG. 4 is a front elevational view of a cam section block and supported cams similar to FIG. 1 showing another embodiment of the invention;

FIG. 5 is a rear elevational view of the cam plate used on the section block of FIG. 4;

FIG. 6 is a fragmentary side elevational view of the cam section block and cams of FIG. 4;

Referring to FIG. 1 of the drawings, reference character 10 designates a cylinder cam section block of a circular knitting machine. The cam section block supports a number of needle controlling cams engageable with the butts 11 of needles 13 moving in the direction indicated. Such cams include a raise cam 12 formed on a face plate 15, an adjustable placer cam 14, a guard cam 16, a wing cam 18, and an adjustable stitch cam 20, all as shown for example in U.S. Pat. No. Re. 28,519 of Aug. 19, 1975. The block 10 also supports a cushion cam 22. The cushion cam is located at the end of a member 24 which is pivotally mounted on a screw 26 that is secured in a side surface 28 of the block. The upper edge 30 of the cushion cam supporting member 24 is biased into contact with the bottom edge of the stitch cam 20 by spring 32 which is wrapped around an unthreaded portion 34 of the screw 26. As shown the spring has one end in engagement with a pin 36 fixed in the member 24 and has its other end in engagement with a wall 38 defining the sides of a recess 40 located in the block 10.

Figure 7:
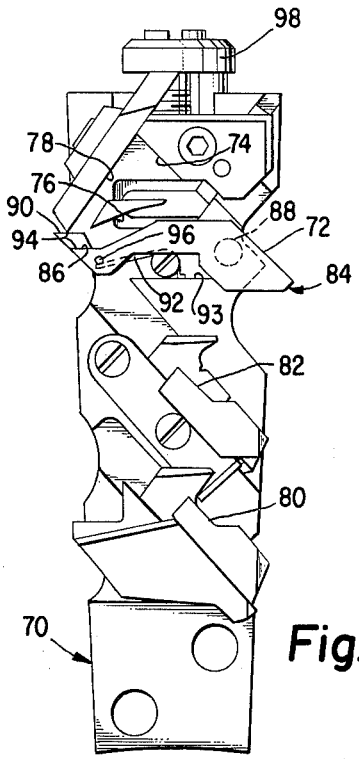
FIG. 7 is a bottom plan view of a dial cam section block and supported cams including an adjustable cushion cam according to the invention.
Figure 8:
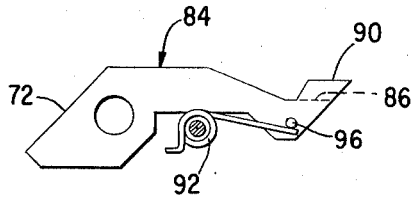
FIG. 8 is a rear view of a member included in the block of FIG. 7 for supporting the cushion cam.
Figure 9:
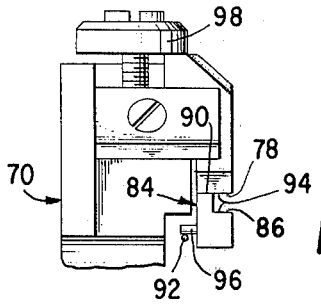
FIG. 9 is a fragmentary side elevational view of the cam section block and cams of FIG. 7.

The stitch cam 20 is of the adjustable kind shown and described in U.S. Pat. No. 3,525,239 and may be moved longitudinally as viewed in FIG. 1 in a generally downward or generally upward direction to a selected position by turning hand operable screw 42. When the stitch cam is moved downwardly it causes the cushion cam supporting member 24 to be pivoted in the plane of the stitch cam about the axis of screw 26 and against the bias of spring 32. The cushion cam 30 moves downwardly with its supporting member and a constant gap 43 is thereby maintained between the stitch and cushion cam. When the stitch cam is adjusted upwardly member 24 is maintained in contact with the cam by the spring 32 and the constant gap is preserved. Therefore regardless of the position into which the stitch cam may be moved, a needle after it has left the stitch cam either because it has reached the end of the cam or prior thereto has bounced off the surface of the cam, may not descend below the stitch cam a distance which is greater than the height of the gap 43 which preferably is not substantially greater than the vertical dimension of a needle butt 11.

In FIG. 4 a cylinder cam section block 44 is shown as including a two step raise cam 46 which is formed on a face plate 47, having a force fit with pins 45 affixed in the block, a guard cam 48, and an adjustable stitch cam 50. The block also supports a cushion cam 52. The cushion cam is located at the end of a member 54 which is pivotally mounted in a recess 56 on a pin 58 that is affixed in the face plate 47. The upper edge 60 of member 54 is biased into engagement with the bottom edge of stitch cam 50 by a leaf spring 64 having one end in a slot 66 in face plate 47 and the other end in engagement with the member 54. When the stitch cam is adjusted downwardly, member 54 is pivoted in a plane perpendicular to the plane of the stitch cam about the axis of pin 58 and against the bias of leaf spring 64. The cushion cam 52 moves downwardly with member 54 and a constant gap 68 is maintained between the stitch cam and cushion cam. When the stitch cam is adjusted upwardly spring 64 maintains the upper edge 60 of member 54 against the stitch cam and the gap remains constant.

Figure 10:
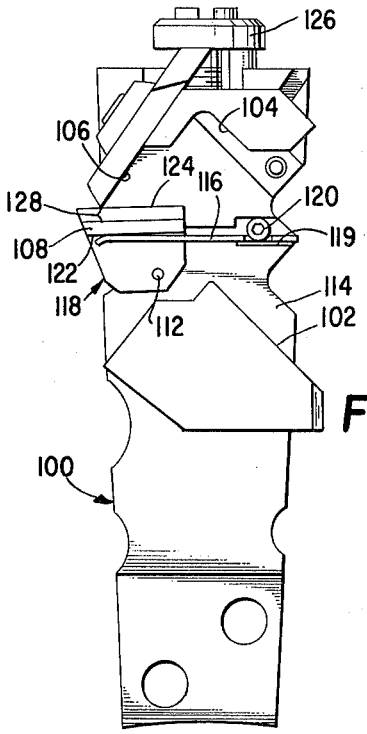
FIG. 10 is a bottom plan view of another dial cam section block and supported cams showing another embodiment of the invention.
Figure 11:
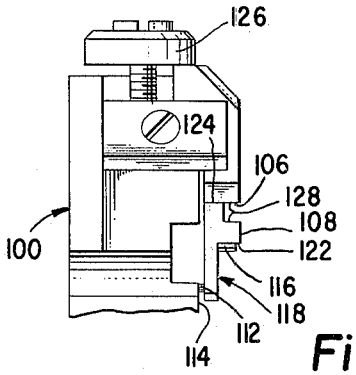
FIG. 11 is a fragmentary side elevational view of the cam section block and cams of FIG. 10.

A dial cam section block 70 including a preliminary raise cam 72, guard cam 74, wing cam 76, adjustable stitch cam 78, and adjustable raise cams 80 and 82 is shown in FIG. 7. The dial cam section block and camming supported on it is similar to that shown and described in U.S. Pat. No. 3,893,309 issued July 8, 1975. The raise cam 72, however, is located on a member 84 which also includes a cushion cam 86. The member 84 is pivoted in a plane perpendicular to the plane of the stitch cam on a pin 88 affixed in section block 70. An edge 90 of the member 84 is biased into engagement with the inner edge of the stitch cam by a spring 92 having one end against a ledge 93 in the section block 70 and its other end against a pin 96 which is affixed in the member 84. The inner edge of the stitch cam is biased by the spring 92 acting through member 84 into engagement with a screw 98 located in the section block 70. The stitch cam may be adjusted by turning the screw into or out of the section block and during adjustment of the stitch cam the spring 92 serves to maintain member 84 in contact with the stitch cam and the stitch cam in contact with the screw 98. A constant gap 94 is therefore maintained between the cushion and stitch cam in all positions of the stitch cam. cam. In FIG. 10 a dial cam section block 100 is shown as including a raise cam 102, a guard cam 104, and a stitch cam 106. A cushion cam 108 is provided on a member 118 which is pivotally mounted for movement in a plane perpendicular to the plane of the stitch cam on pin 112 affixed in the face 114 of the section block. A leaf spring 116 affixed at one end against a surface 119 of the section block 100 by a set screw 120 bears at its other end against a ledge 122 on a member thereby causing surface 124 on the member to bear against the inner edge of the stitch cam and the upper edge of the stitch cam to bear against a screw 126 with which the stitch cam may be adjusted. A constant gap 128 between the stitch and cushion cam is therefore maintained in all adjusted positions of the stitch cam.

The members supporting the cushion cams on each of the various cam section blocks of FIGS. 1, 4, 7 and 10 may be readily removed from the blocks and the cushion cams easily machined after their removal, member 24 on section block 10 by removing screw 26, member 54 on section block 44 by detaching face plate 47 from the block and then lifting the member off pin 58, member 84 on section block 70 by removing spring 92 and then lifting the member off pin 88, and member 118 on section block 100 by removing spring 116 and then lifting the member off pin 112.

Although the invention has been described in its preferred forms with a certain degree of particularity, it is to be understood that the present disclosure of the preferred forms has been made by way of example only and that numerous changes in the details of construction and the combination and arrangement of parts may be resorted to without departing from the spirit and the scope of the invention.

Having thus set forth the nature of the invention, what is claimed is:

1. In combination with needle controlling camming for a knitting machine, on cam supporting section block means, the camming including an adjustable stitch cam and including a cushion cam to limit the travel of needles drawn by the stitch cam, a (movable) member pivotably mounted in the section block means to position the cushion cam below the stitch cam, and spring means biasing said member into engagement with the stitch cam, said member being movable by the stitch cam when the stitch cam is adjusted in one direction and being movable by the spring means when the stitch cam is adjusted in the opposite direction such that a constant gap is maintained between the stitch and cushion cam in various adjusted positions of the stitch cam.

2. The combination of claim 1 wherein said member is pivotally mounted for movement in a plane perpendicular to the plane of the stitch cam.

3. The combination of claim 1 wherein said member is pivotally mounted for movement in the plane of the stitch cam.

4. The combination of claim 1 wherein said member includes a preliminary raise cam as a part thereof.

* * * * *